United States Patent [19]

Connelly

[11] Patent Number: 4,516,478

[45] Date of Patent: May 14, 1985

[54] CYLINDER DRIVEN RECIPROCATOR

[76] Inventor: Dale L. Connelly, Rte. 3, McAAP, Box 615B, McAlester, Okla. 74501

[21] Appl. No.: 491,833

[22] Filed: May 5, 1983

[51] Int. Cl.[3] ..... B66D 1/08; F01B 9/00

[52] U.S. Cl. ..... 92/137; 254/386

[58] Field of Search ..... 92/137; 91/383; 254/386, 285, 286, 399

[56] References Cited

U.S. PATENT DOCUMENTS

| | | | |
|---|---|---|---|
| 469,368 | 2/1892 | Bell et al. | 254/386 |
| 2,336,148 | 12/1943 | Zoll | 254/386 |
| 3,998,432 | 12/1976 | Uldricks et al. | 254/386 |

FOREIGN PATENT DOCUMENTS

| | | | |
|---|---|---|---|
| 1060687 | 7/1959 | Fed. Rep. of Germany | 254/386 |
| 141666 | 5/1980 | Fed. Rep. of Germany | 254/386 |
| 151456 | 12/1961 | U.S.S.R. | 254/399 |

*Primary Examiner*—Paul E. Maslousky

*Attorney, Agent, or Firm*—Anthony T. Lane; Robert P. Gibson; Robert O. Richardson

[57] ABSTRACT

A cylinder driven reciprocator uses a block and tackle output to broaden the mechanical range of the cylinder. The output force, speed, and travel distance depends upon the number of moveable pulleys between a fixed reference point and the output attachment on the cable.

3 Claims, 7 Drawing Figures

CYLINDER DRIVEN RECIPROCATOR

GOVERNMENT INTEREST

The invention described herein may be manufactured and/or used by or for the Government for governmental purposes without the payment of any royalty thereon.

BACKGROUND OF THE INVENTION

Cylinders have a maximum stroke which limits the output length of travel. The output stroke usually has a speed proportional to that of the cylinder piston. A multiple of outputs with various speeds and length of travel is beyond the capability of most cylinder powered actuators.

SUMMARY OF PRESENT INVENTION

In accordance with the present invention a hydraulic or pneumatic driven cylinder is a primary driving source. Its operating range is increased beyond its stroke capacity by applying the principle of the block and tackle with its input and output reversed from the usual application. The reciprocator consists of an upper mounting of pulleys, and a lower mounting of pulleys. These pulleys rotate but are fixed relative to each other. Between the two mountings is a moveable frame of pulleys. This moveable frame is attached to and moveable by an actuating cylinder with a rod that reciprocates between extended and retracted positions as determined by a hydraulic or pneumatic input to the cylinder. A single cable as a single loop connects all pulleys together. When the cylinder extends or retracts in a reciprocating movement, the moveable frame is moved relative to the upper and lower pulleys. Each piece of cable between the pulleys travels a distance depending upon the number of pulleys between it and a fixed reference point on the reciprocator. A hydraulic or pneumatic cylinder inputs a force F at a speed S over a distance D to a moving tackle. The output from the cable after passing around the Nth moveable pulley has an output force of F2N at a speed of 2NS and moves over a distance of 2ND.

The advantages of using the cylinder driven reciprocator of the present invention are many. The output stroke is magnified to exceed the length of the cylinder itself. The output speed is magnified to exceed the speed of the cylinder rod itself. Multiple outputs at various speeds and length of travel are possible. As compared to a cable or rodless cylinder the present reciprocator has a higher working capability due to higher pressure ratings for piston rod type cylinders and inherantly superior seal properties of the cylinder against leakage. When comparing this specific application as a reciprocator with a 10 foot stroke with a commercially available motor driven unit, it is more simple with no reversing clutches, fewer parts, lower maintenance and lower production costs. It has a quieter operation since the power sources are remotely located. There is no messy lubrication of chains or other moving parts. Also, the cylinder is of smaller cross sectional size.

While the reciprocator apparatus of the present invention can perform the reciprocating functions performed by cylinders, cable cylinder, and motor driven reciprocators, there are other design options. For example, an output may be made from any of the cable lengths and thus an even multiple of output speed and distance can be selected. Any of the stationary pulleys can be made the fixed reference point by making suitable arrest/release provisions at that point on the cable. Any of the cable lengths can be routed along a remote path in any or many directions, using appropriately located fixed pulleys, to provide output in many directions and at various multiples of speed and distance. Any cable can be connected to a rack and pinion or other geared arrangement to provide rotational or linear motion. Also, chain and sprockets can be used instead of cables and pulleys in the reciprocator apparatus.

DETAILED DESCRIPTION OF ILLUSTRATIVE EMBODIMENTS

Figure 1:
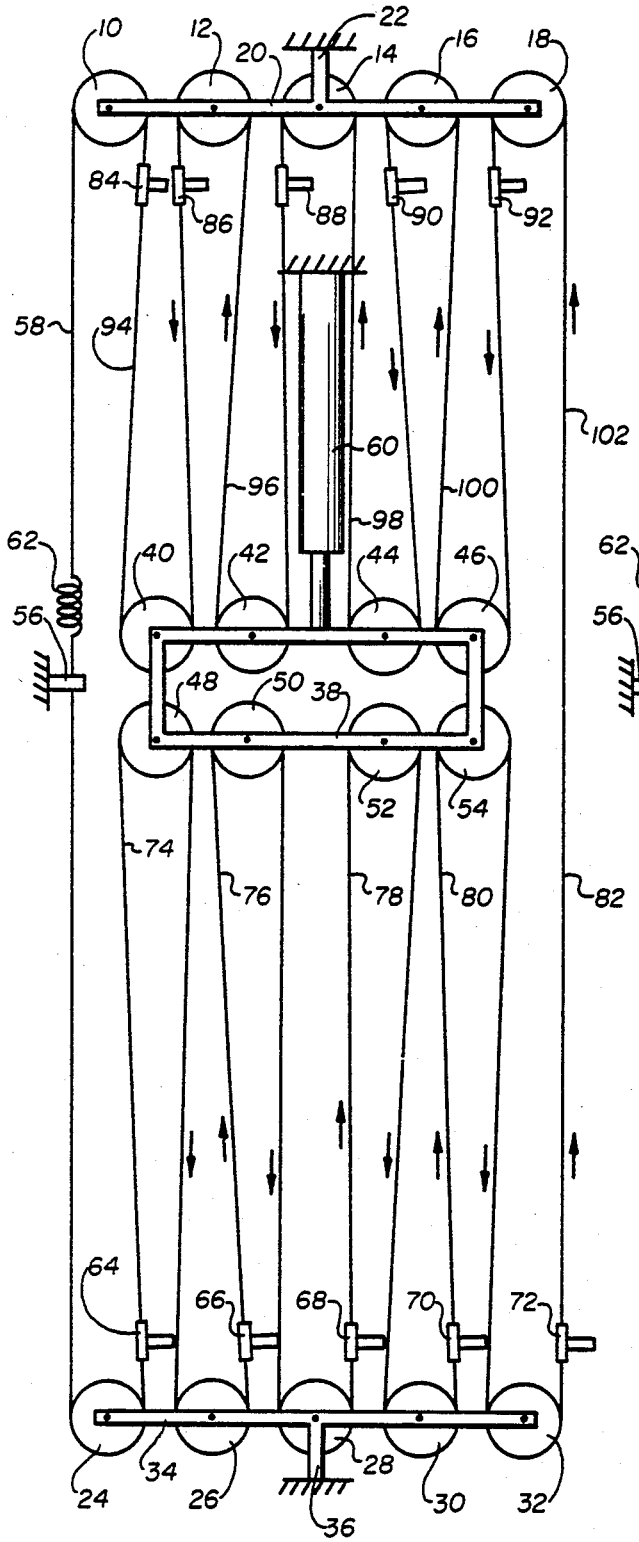
FIG. 1 is a schematic illustration of the basic features and mechanics of motion in the present invention.

Reference is now made to FIG. 1 wherein is shown five pulleys 10, 12, 14, 16, and 18 rotatably mounted on a top mounting 20. This mounting is shown as being grounded at 22 to show that it is not moveable. The ground 22 may be the ceiling of a room or a top support of an enclosing structure. A similar set of pulleys 24, 26, 28, 30, and 32 are rotatably mounted on a bottom mounting 34 which is grounded at 36 to show that it is not moveable. It may be fastened to the floor of a building or supporting structure. Thus mountings 20 and 34 maintain a fixed space distance from each other. A moveable frame 38 has eight pulleys 40, 42, 44, 46, 48, 50, 52, and 54 rotatably mounted thereon. Upper and lower pulleys may be combined as double pulleys, if desired, since the corresponding upper and lower pulleys rotate in the same direction at the same speed.

Commencing at a grounded or unmoveable reference point 56 on a building wall or side of a support structure, a cable 58 is looped over all of the pulleys as shown. The cable loops sequentially over top pulley 10, pulley 40 on moveable frame 38, back to upper pulley 12, down to pulley 42 on frame 38, back to top pulley 14, down to pulley 44 on moveable frame 38, back to upper pulley 16, down to pulley 46 on moveable frame 38 and back to upper pulley 18.

From pulley 18 the cable continues down to pulley 32 on the lower mounting 34. From there the cable loops are a mirror image of the upper half. The cable passes from pulley 32 up to pulley 54 on the moveable frame 38, back down to pulley 30 on lower mounting, up and over pulley 52 on the moveable frame, back down and around pulley 28 on the lower mounting, up over pulley 50 on moveable frame 38, down and around pulley 26 on the lower mounting, up over pulley 48 on moveable frame 36, down and around pulley 24 on lower mounting 34 and finally attached to the unmoveable reference point 56. It should be understood that this portion of the cable is immoveable but need not be connected to the same part of the supporting frame as the beginning of the cable. A tension spring 62 is placed somewhere in the cable loop to take up slack to keep the cables from "jumping the track" and to keep the cables on the pulley roller rims. The cylinder 60 may be of the pneumatic or hydraulic type with a suitable fluid source and switching apparatus, not shown, to cause the cylinder to extend and retract in a reciprocating motion. The extend-retract cycle may be varied as desired with appropriate timing and switching apparatus, not shown. The moveable frame 38 and cylinder 60 shown in FIG. 1 is in the retracted position. For illustrative purposes, output devices 64, 66, 68, 70, and 72 are placed on a horizontal plane on cable segments 74, 76, 78, 80, and 82. Additional output devices 84, 86, 88, 90, and 92 are attached on a horizontal plane to the cable segments 94, 96, 98, 100, and 102 between the moveable frame 38 and the immoveable frame 20.

Figure 2:
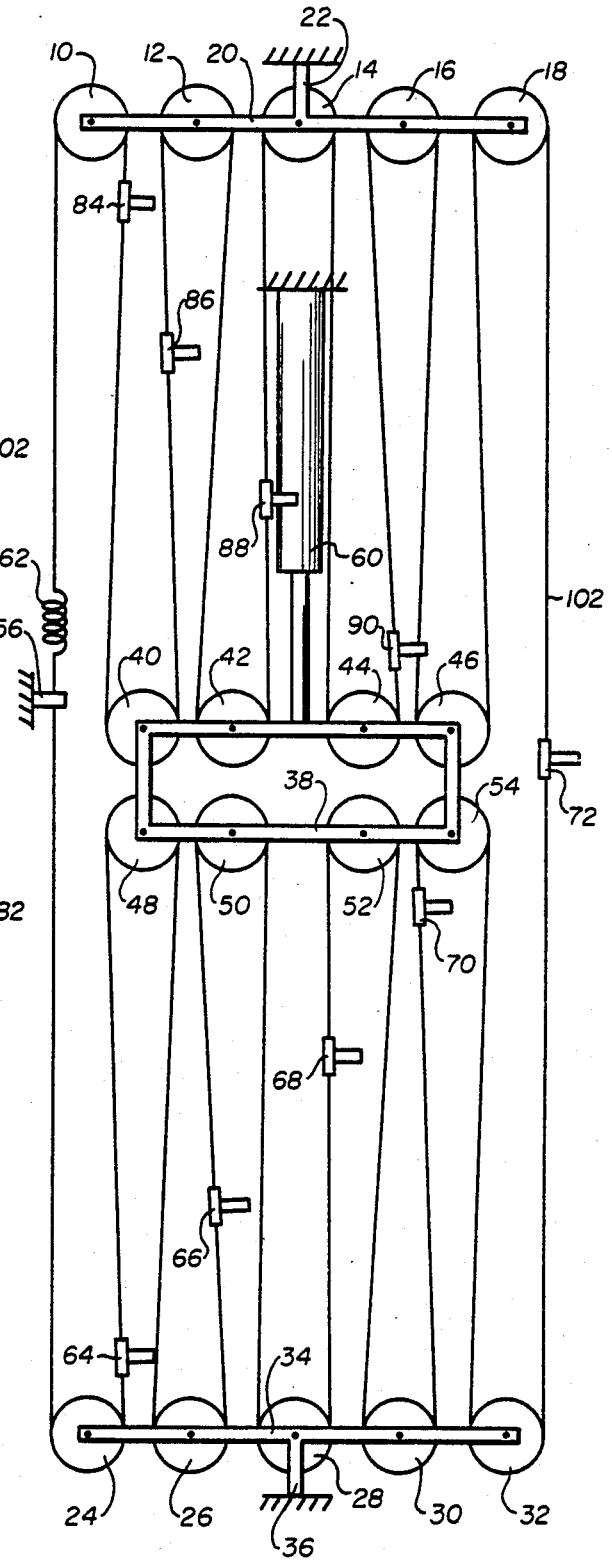
FIG. 2 is a view similar to FIG. 1 but with the cylinder extended.

FIG. 2 is a view similar to FIG. 1 except that cylinder 60 has moved to its extended position, moving frame 38 downwardly the length of the cylinder stroke. The cables move in the direction of arrows as shown during extension of the cylinder. Output devices 64 and 84 did not move. Output devices 66 and 86 have moved twice the distance of the cylinder stroke, output devices 68 and 88 have moved four times, output devices 70 and 90 have moved six times, and output devices 72 and 92 have moved eight times the cylinder stroke distance. (Actually, output device 92 cannot move eight times the cylinder stroke in this view since it would have to move around pulley 46 in so doing. However, if the distance between the upper frame 20 and moveable frame 38 is eight times the cylinder stroke length, output device 92 would move the designated length). It can thus be seen that the distance an output device travels depends upon the number of moveable pulleys in a loop commencing and ending at the ground, fixed point 56.

For example, if cable portions 76 and 96 were connected, only moveable pulleys 40 and 48 would be in the loop and output devices 66 and 86 move twice the distance of the cylinder stroke. If cable portions 78 and 98 are connected, pulleys 40, 42, 44, 48, 50, and 52 are in the loop, and output devices 70 and 90 travel six times the cylinder stroke distance. With all eight pulleys in the loop, as shown, output devices 72 and 92 travel eight times the cylinder stroke distance.

Figure 3:
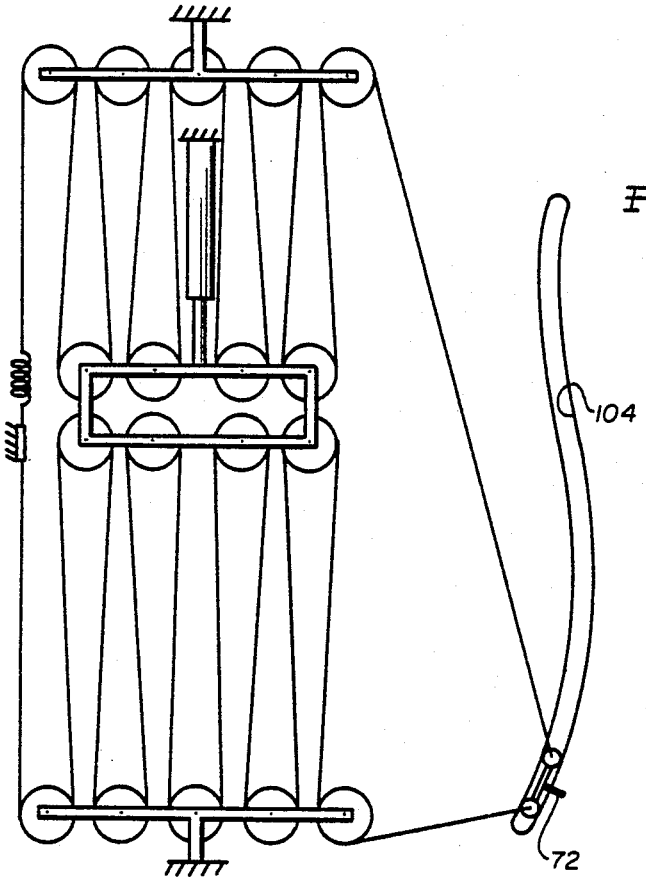
FIG. 3 is a schematic illustration wherein the output takes a remote path of movement.
Figure 4:
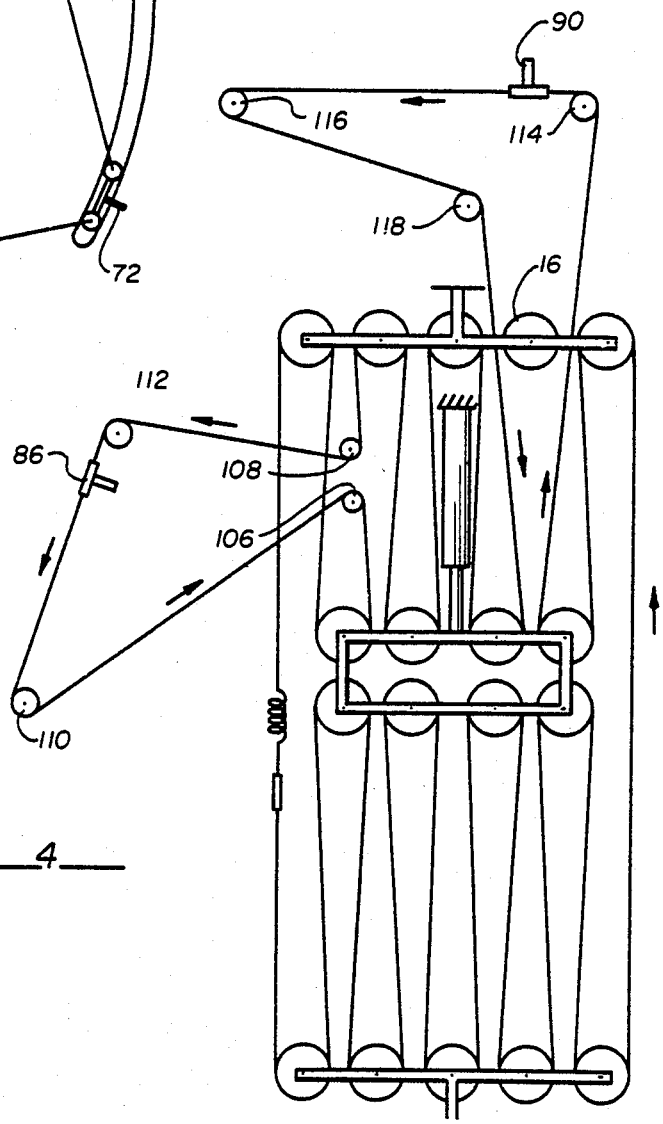
FIG. 4 is a schematic illustration wherein various outputs have various multiples of speed and distance relative to the input.
Figure 5:
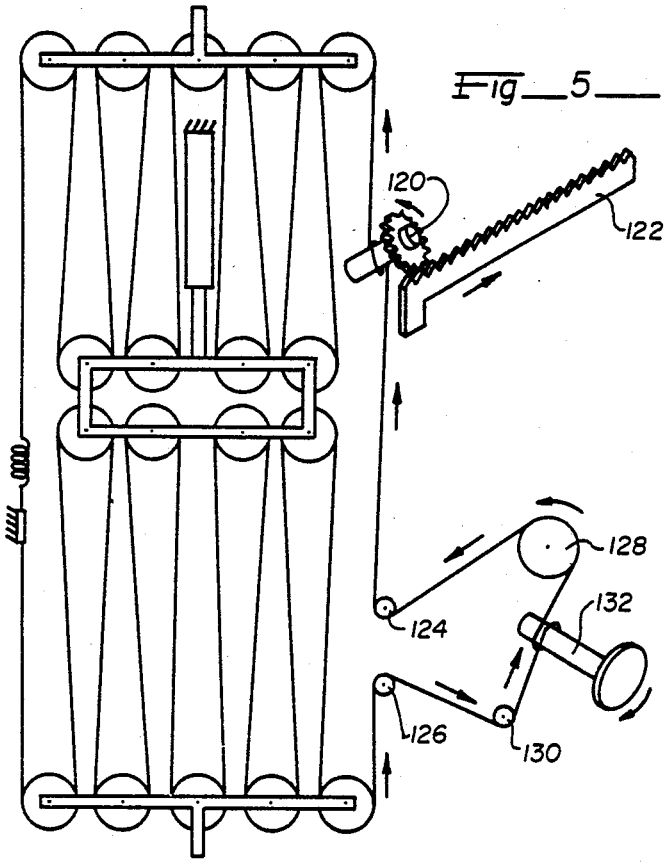
FIG. 5 is a schematic illustration wherein various outputs have rotary or linear motion.

Variation from the basic configuration shown in FIGS. 1 and 2 are possible, as shown in FIGS. 3, 4, and 5. In FIG. 3 an output device 72 can be made to follow some remote path 104. FIG. 4 shows how any cable portion can be routed along any external path for the output. Additional fixed pulleys 106, 108, 110, and 112 provide output device 86 with a two stroke distance in an angular direction. Additional fixed pulleys 114, 116, 118 (pulley 16 is not needed), provides output device 90 with a horizontal six cylinder stroke movement. In FIG. 5 an output device 120 has a rotary motion. By attaching a rack 122 to it, the vertical movement of the cable is transformed to a horizontal transverse motion. Additional rollers 124, 126, 128, and 130 provide a rotary motion on an angular axis to roller 132.

Figure 6:
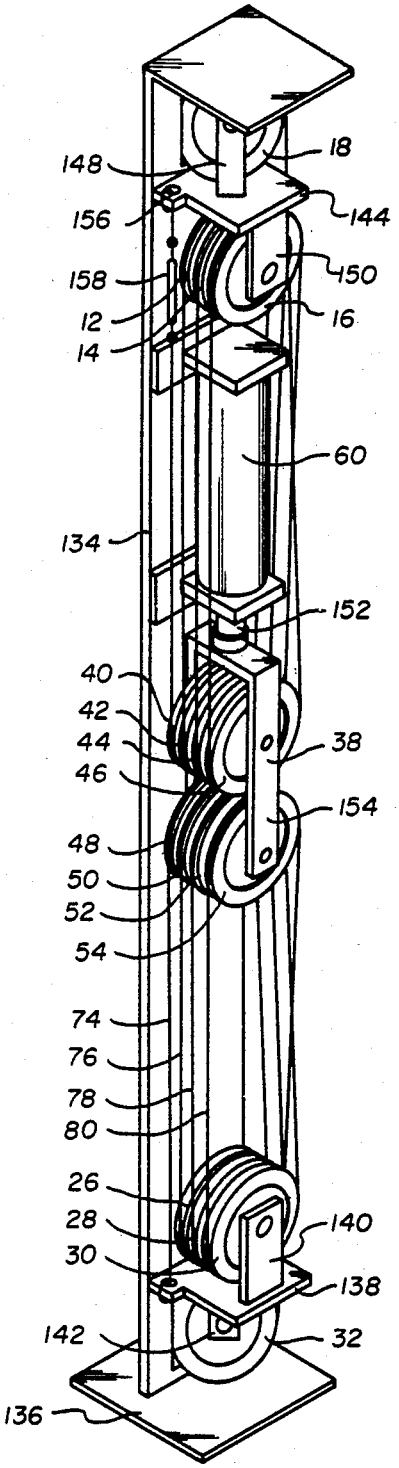
FIG. 6 is a perspective view of a preferred embodiment.

A specific embodiment of the invention is shown in FIG. 6, used to move a paint spray gun vertically as items to be painted are passed by it on a conveyor belt. For this purpose a vertical support 134 is mounted on a base 136. Spaced above the base is a pulley mounting 138. This mounting consists of a plate extending from vertical support 134 with vertically extending pulley mounts 140 and 142 extending upwardly and downwardly respectively. Pulley mount 140 rotatably supports three pulleys, 26, 28, and 30, corresponding to like numbered pulleys in FIG. 1.

Spaced below the top of vertical support 134 is a top pulley mounting 144. This mounting consists of a plate 144 extending from vertical support 134 with vertically extending pulley mounts 148 and 150 extending upwardly and downwardly respectively. Pulley mount 148 rotatably supports a single pulley 18, corresponding to pulley 18 in FIG. 1. Pulley mount 150 rotatably supports three pulleys 12, 14, and 16, corresponding to like numbered pulleys in FIG. 1.

Attached to the vertical support 134 is an actuation cylinder 60 having an extendable piston rod 152. Attached to the piston rod is a moveable pulley frame 38 similar in function to frame 38 in FIG. 1. This frame has a pair of legs 154 between which are rotatably mounted four upper pulleys 40, 42, 44, and 46, and four lower pulleys 48, 50, 52, and 54, corresponding to like numbered pulleys in FIG. 1. The apparatus for extending and retracting piston rod 152 in cylinder 60 is not shown.

The cable length numbers in FIG. 6 correspond to the cable length numbers in FIG. 1. The looping of the cable over the pulleys will now be described. By tieing the end of cable length 74 to the pulley mounting 138, the pulley 24 in FIG. 1 is not needed. The cable is looped over pulley 48 on moveable frame 38, down and around pulley 26 on lower pulley mounting 138, up and over pulley 50, down and around pulley 28, up and over pulley 52, down and around pulley 30, up and over pulley 54, down and around pulley 32 and is attached to output device 72, shown in FIG. 7. This output device is mounted to move along a vertical track and will be described in greater detail hereinafter. The cable continues from the output device up and over pulley 18 on the top pulley mounting 144, down and around pulley 46 on the moveable frame 38, up and over pulley 16 on the top pulley mounting 144, down and around pulley 44, up and over pulley 14, down and around pulley 42, up and over pulley 12, down and around pulley 40, and up to a terminal fastening 156 on the vertical support 134. Pulley 10 in FIG. 1 is not needed in this embodiment. The turnbuckle 158 is used merely to take up any play in the cable.

Figure 7:
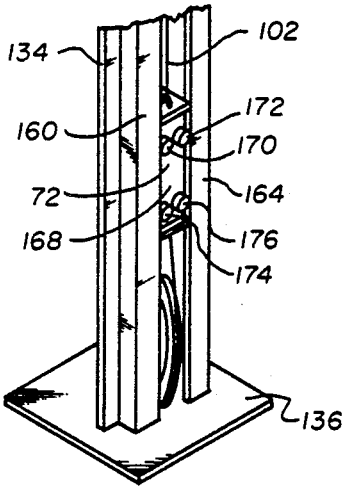
FIG. 7 is a partial view of the output of the embodiment in FIG. 6 for vertical reciprocal movement of a paint sprayer apparatus.

The output device 72 is more clearly shown in FIG. 7. As can be seen, the vertical support 134 includes a pair of U-shaped beams 160 and 164. The output device 72 includes a mounting block 168 to which the paint spray gun, not shown, may be attached. Block 168 has four rollers 170, 172, 174, and 176 which bear against the inner edges of the U-shaped beams 160 and 164. Not shown, additional rollers extend laterally from the mounting block 168 into the U-chanels of the beams 160 and 164. In this manner block 168 is free to move vertically in response to upper cable 102 and lower cable 82 attached thereto.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A reciprocator comprising:

a vertical support, a base upon which said support is mounted, a lower pulley mounting plate and an upper pulley mounting plate on said support, pulley mounts extending above and below both pulley mounting plates, said pulley mounts extending above said upper pulley mounting plate and below one of said pulley mounts extending said lower pulley mounting plate supporting single pulleys thereon, said vertical support including a trackway having a pair of U-shaped beams, an output mounting block slidably mounted between said beams and between said single pulleys, an extensible member mounted on said vertical support, a moveable frame attached to said extensible member and moveable therewith, said moveable frame having an upper row of pulleys and a lower row of pulleys thereon, one of said pulley mounts extending below said upper pulley mounting plate and one of said pulley mounts extending above said lower pulley mounting plate having a plurality of pulleys mounted thereon, a cable with ends attached to said upper and lower pulley mounting plates, said cable being looped continuously around said pulleys on said moveable frame and on said upper and lower pulley mounts on said upper and lower pulley mounting plates, said output mounting block being attached to said cable and moveable therewith upon actuation by movement of said extensible member.

2. A reciprocator as set forth in claim 1 wherein there are four cable looped pulleys on said upper row and four cable looped pulleys on said lower row of said moveable frame, said output mounting block on said cable reciprocates at eight times the speed and distance said extensible member reciprocates.

3. A reciprocator as in claim 1 wherein said output mounting block has rollers thereon engageable with inner edges of said U-shaped beams to permit movement of said output mounting block therealong.

* * * * *

UNITED STATES PATENT AND TRADEMARK OFFICE

CERTIFICATE OF CORRECTION

PATENT NO. : 4,516,478

DATED : May 14, 1985

INVENTOR(S) : Dale L. Connelly

It is certified that error appears in the above—identified patent and that said Letters Patent is hereby corrected as shown below:

On front sheet of patent.

In block [76].

"Inventor: Dale L. Connelly, Rte 3. McAAP, Box 615B, McAlester, Okla. 74501" has been changed to:

--Inventor: Dale L. Connelly, 5439 Thomas Drive, N.E., Albuquerque, New Mexico 87111.--

In the drawing, Figure 1, the caption --34-- has been added pointing to the bottom mounting, the same as is found in Figure 2.

In column 1, line 42, "F1N" has been deleted and replaced with --F/2N--.

In line 52, "inherantly" has been changed to --inherently--.

In column 2, line 68, "36" has been changed to --38--.

In column 3, line 44, "78" has been changed to --80--. In line 45, "98" has been changed to --100--.

UNITED STATES PATENT AND TRADEMARK OFFICE

CERTIFICATE OF CORRECTION

PATENT NO. : 4,516,478

DATED : May 14, 1985

INVENTOR(S) : Dale L. Connelly

It is certified that error appears in the above—identified patent and that said Letters Patent is hereby corrected as shown below:

(Continued from previous sheet)

In claim 1, column 5, line 8, "said pulley" was changed to --one of said pulleys--. In line 9, "below" has been deleted. In line 10, --below-- was inserted after --extending--.

Signed and Sealed this

*Seventeenth* Day of *December 1985*

[SEAL]

*Attest:*

DONALD J. QUIGG

*Attesting Officer*

*Commissioner of Patents and Trademarks*